US007928334B2

(12) United States Patent
Kramlich

(10) Patent No.: US 7,928,334 B2
(45) Date of Patent: Apr. 19, 2011

(54) ROTARY ACTUATOR WITH MAGNETIC BRAKE

(75) Inventor: Andreas Kramlich, Schweinfurt (DE)

(73) Assignee: Preh GmbH (DE)

( * ) Notice: Subject to any disclaimer, the term of this patent is extended or adjusted under 35 U.S.C. 154(b) by 678 days.

(21) Appl. No.: 11/949,712

(22) Filed: Dec. 3, 2007

(65) Prior Publication Data

US 2008/0196541 A1 Aug. 21, 2008

Related U.S. Application Data

(63) Continuation of application No. PCT/EP2006/006451, filed on Jul. 3, 2006.

(51) Int. Cl.
*H01H 19/02* (2006.01)

(52) U.S. Cl. ..... 200/336; 345/184

(58) Field of Classification Search ..... 200/564–567, 200/318, 323, 336; 341/22, 27, 35; 345/184; 335/205–207, 194, 77; 74/529
See application file for complete search history.

(56) References Cited

U.S. PATENT DOCUMENTS

| | | | | |
|---|---|---|---|---|
| 4,859,922 | A | 8/1989 | Tauchenitz et al. | |
| 5,187,630 | A * | 2/1993 | MacKay et al. | 360/137 |
| 6,710,707 | B2 * | 3/2004 | Onodera | 340/407.1 |
| 6,987,508 | B2 * | 1/2006 | Numata et al. | 345/184 |
| 7,038,148 | B2 * | 5/2006 | Shirakawa | 200/43.11 |
| 7,187,359 | B2 * | 3/2007 | Numata et al. | 345/158 |
| 7,489,309 | B2 * | 2/2009 | Levin et al. | 345/184 |
| 7,570,254 | B2 * | 8/2009 | Suzuki et al. | 345/184 |
| 7,643,017 | B2 * | 1/2010 | Lai et al. | 345/184 |
| 7,714,242 | B2 * | 5/2010 | Ishigaki et al. | 200/336 |
| 7,723,628 | B2 * | 5/2010 | Jarrett | 200/332 |
| 7,732,724 | B2 * | 6/2010 | Otani et al. | 200/565 |
| 7,741,938 | B2 * | 6/2010 | Kramlich | 335/77 |
| 7,767,916 | B2 * | 8/2010 | Kurihara et al. | 200/38 R |
| 2001/0021667 | A1 | 9/2001 | Fujimoto et al. | |

FOREIGN PATENT DOCUMENTS

| | | | |
|---|---|---|---|
| DE | 10 2005 003 593 | A1 | 9/2005 |
| EP | 1480238 | A2 | 11/2004 |

* cited by examiner

*Primary Examiner* — Michael A Friedhofer

(74) *Attorney, Agent, or Firm* — Cantor Colburn LLP

(57) ABSTRACT

A rotary actuator is provided for a motor vehicle, having a control knob, a housing, an actuating shaft that is rotationally fixed to the control knob, and electromagnetic means that act on the control knob so as to permit a detent or locking of the rotation of the control knob, wherein a coil is arranged in the housing in a rotationally fixed manner, and a disk-shaped flux guide is attached to the actuating shaft so as to be rotationally fixed and movable along the actuating shaft, and the flux guide can be pressed against the coil and/or the housing.

6 Claims, 1 Drawing Sheet

ROTARY ACTUATOR WITH MAGNETIC BRAKE

This nonprovisional application is a continuation of International Application No. PCT/EP2006/006451, which was filed on Jul. 3, 2006, and which claims priority to German Patent Application No. DE 102005030806, which was filed in Germany on Jul. 1, 2005, and which are both herein incorporated by reference.

BACKGROUND OF THE INVENTION

1. Field of the Invention

The present invention relates to a rotary actuator for a motor vehicle, having a control knob, a housing, an actuating shaft that is rotationally fixed to the control knob, and electromagnetic means that acts on the control knob so as to permit a detent or locking of the rotation of the control knob.

2. Description of the Background Art

Oftentimes in modern motor vehicles, operating elements are used that have multiple control functions assigned to them. Thus, through selection in a display or menu buttons a rotary actuator can be given the control task of adjusting the volume of a radio receiver and can at the same time be given the control task of adjusting a three-speed fan. In this connection, different types of tactile feedback as well as limits as end stops have to be implemented in one rotary actuator.

One possibility for achieving different detent positions in a rotary actuator is described in DE 101 53 002A1. The rotary actuator includes an actuating shaft that is rotatably mounted in a housing with a detent arrangement that cooperates therewith and contains a rotatable holding element, which can be braked or locked with respect to the housing by an associated solenoid-controlled locking element in order to activate the detent arrangement, wherein the solenoid contains a magnetic circuit consisting of a hole and a movable armature arrangement, and also contains a winding. In this connection, the magnetic circuit contains a permanent magnet that is designed and arranged such that the solenoid acts as a bistable solenoid that may be switched through brief application of current to the winding. The arrangement of teeth and a detent ring that surrounds the teeth and works together with the solenoid permits individual adjustment of the detent action. Also described is the use of locking elements similar to brake calipers, which act on the surface of a detent element that is at least disk-shaped or arc-shaped, in order to produce suitable tactile feedback.

SUMMARY OF THE INVENTION

It is therefore an object of the present invention to provide a rotary actuator with which it is possible to produce any desired tactile feedback patterns. In addition, the rotary actuator should be simple in design and economical to manufacture.

In an embodiment, a coil can be arranged in the housing in a rotationally fixed manner, and a friction disk and a disk-shaped flux guide can be attached to the actuating shaft of the rotary actuator so as to be rotationally fixed and movable along the actuating shaft, wherein the friction disk is located between the coil and the flux guide so that the flux guide can be pressed against the coil over the friction disk.

The inventive design of the rotary actuator now makes it possible to implement any desired tactile feedback patterns at a control knob of the rotary actuator. This is advantageous especially when the rotary actuator is used for multiple control functions. Thus, in accordance with the invention, it is possible to produce many small detents as well as center detents and end stops. In this context, the typical detents differ from the center detents in that center detents, in contrast to normal detents, require an increased application of force to rotate past the center detent. An interlocking connection between the friction disk and the actuating shaft, as well as between the flux guide and the actuating shaft, ensures a simple design of the magnetic means, which in turn has a beneficial effect on the manufacturing costs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
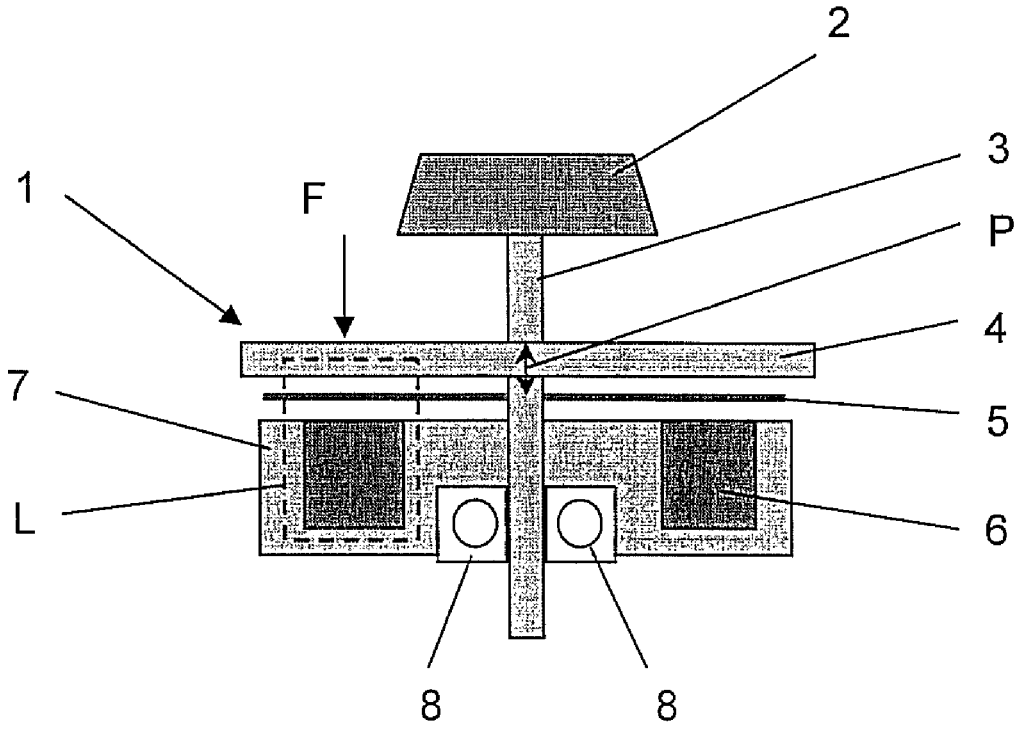
FIG. 1 is a side view, which is shown in partial section, of a rotary actuator equipped according to the invention.

As can be seen in FIG. 1, the rotary actuator 1 includes a control knob 2, to which an actuating shaft 3 is rotationally fixed. Beneath the control knob, a flux guide 4 and a friction disk 5 are attached to the shaft so as to be movable along the actuating shaft 3. The flux guide 4 and the friction disk 5 are movable along the actuating shaft 3 and in the direction of the arrow P over the actuating shaft 3. An interlocking connection is possible, wherein the actuating shaft 3 is profiled in design, at least in the area of the flux guide 4 and the friction disk 5, and the flux guide 4 and the friction disk 5 have an opening corresponding to the profile. Beneath the friction disk 5, a coil 6 is arranged around the actuating shaft 3. The coil 6 is held in a part of the housing 7 of the rotary actuator 1. At the same time, the housing 7 carries the support 8 of the actuating shaft 3. It is possible here to use an ordinary commercial bearing, such as a plain bearing, roller bearing, or ball bearing, for example.

The coil 6 contained in the housing 7 can either be an annular coil element, which is to say surrounding the actuating shaft 3, or can be accommodated as a separate coil element at two or more positions in the housing. When current is applied to the coil 6, the coil 6 induces a magnetic field that passes through the housing 7 and the flux guide 4 in the direction of the dashed line L, for example. The housing 7 as well as the flux guide is preferably made of an electrically conductive material. If the housing 7 that accommodates the coil 6 is made of an electrically conductive material, the housing 7 forms a lower part 7 guiding the magnetic flux, and the flux guide 4 forms an upper part 4 guiding the magnetic flux.

When an electric current is now applied to the coil 6, the magnetic field lines exert a force F that presses the flux guide 4 against the friction disk 5 onto the housing 7 and the coil 6. The user of the control knob 2 perceives different tactile feedback at the rotary actuator 1 depending on the strength of the contact force F. Hence, any desired detent pattern can be adjusted, which is to say with respect to the detent intervals and detent forces at the control knob. It is thus possible according to the invention to freely program many small detents as well as center detents and end stops. Programming is accomplished here by the current that is passed through the coil 6 in a time-limited manner at the intervals corresponding to the detents, so that the force F corresponding to the detent is exerted on the flux guide, and thus a braking effect is palpable at the control knob 2 due to the interlocking connection with the actuating shaft 3.

Alternatively, it is possible to use the flux guide 4 without the friction disk 5. According to the invention, the friction disk 5 can be implemented with a regional and annular coating 9 that can be applied to one or both sides of the friction disk 5. The coating 9 serves here to reduce the adhesive forces between the magnetic means 4, 7, 6. At the same time, the coating 9 serves as a sliding aid between the flux guides 4, 7 that move relative to one another. In this context, materials that have a lower strength than the base material of the flux guides 4, 7 may be used as a coating 9. One material that can be used here is copper, for example. In a preferred embodiment, the coating 9 is applied to the friction disk 5 in the shape of a ring.

In order to be able to evaluate the rotational motions of the control knob 2, it is possible according to the invention to affix an angular position sensor 10 to the actuating shaft 3. The customary angular position sensors 10 known from the prior art are used as the angular position sensor 10 here. In the case in which the electromagnetic means implement an end stop, the magnetic means 4, 5, 6, 7 are pressed against one another. In order to be able to release the magnetic means 4, 5, 6, 7 from this position again, on the one hand a high-sensitivity angular position sensor 10 is used, which detects even the slightest rotational motions of the control knob 2 in the direction opposite the stop, and in doing so releases the magnetic means 4, 5, 6, 7, and on the other hand the play with which the flux guide 4 and the friction disk 5 are accommodated in the housing is sufficient to move the control knob 2 slightly, so that the direction of rotation is detected by the angular position sensor 10 and the magnetic means 4, 5, 6, 7 are released.

Figure 2:
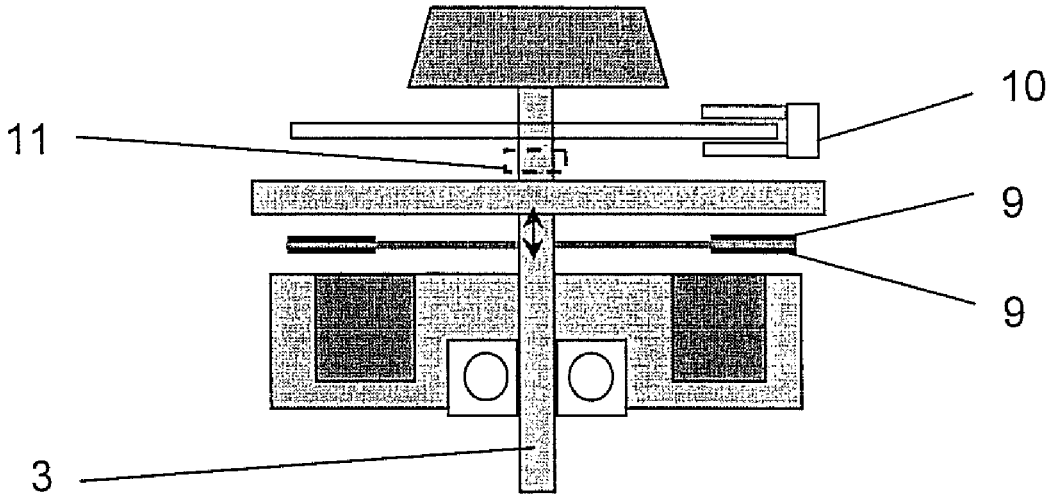
FIG. 2 is an inventive rotary actuator with an elastic element, shown in the same view.

Aside from the play of the flux guide 4 and the friction disk 5, play being undesirable in rotary actuators 1, it is possible according to the invention to insert an elastic element 11 in the actuating shaft 3 in order to permit relative motion between the angular position sensor 10 and the magnetic means 4, 5, 6, 7 and thus initiate a release of the force F. A material that permits torsion, even if only very slight, may be used as the elastic element 11 here, since the angular position sensor 10 is primarily responsible for the impulse to release the force F. A preferred position for a suitably designed elastic element 11 is shown in dashed lines in the actuating shaft 3 in FIG. 2.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A rotary actuator for a motor vehicle, comprising:

a control knob;

a housing;

an actuating shaft that is rotationally fixed to the control knob;

an electromagnetic device that acts on the knob so as to permit a detent or locking of the rotation of the control knob;

wherein the electromagnetic device includes a coil arranged in the housing in a rotationally fixed manner;

wherein the electromagnetic device further includes a disk-shaped flux guide attached to the actuating shaft so as to be rotationally fixed and movable along the actuating shaft, wherein the guide is pressed against the coil or the housing; and wherein a friction disk is attached between the coil and the flux guide so as to be rotationally fixed and moveable along the actuating shaft.

2. The rotary actuator according to claim 1, wherein a coating is applied to one or both sides of the friction disk, and wherein the coating is made of a material that has a lower strength than the base material of the friction disk.

3. The rotary actuator according to claim 2, where in the coating is made of copper.

4. The rotary actuator according to claim 1, wherein an angular position sensor is affixed to the actuating shaft.

5. The rotary actuator according to claim 4, wherein an elastic element is integrated in the actuating shaft, below the control knob and between the angular position sensor and magnetic means, so that relative motion is possible between the magnetic means and the angular position sensor.

6. The rotary actuator according to claim 1, where in the actuating shaft is held in the housing in a bearing or in a ball bearing.

* * * * *